United States Patent [19]

Matula

[11] 4,419,109

[45] Dec. 6, 1983

[54] MEANS FOR DEGASSING PAPER PULP STOCK

[75] Inventor: Jouni Matula, Savonlinna, Finland

[73] Assignee: Enso-Gutzeit OY, Helsinki, Finland

[21] Appl. No.: 381,786

[22] Filed: May 25, 1982

[30] Foreign Application Priority Data

Jun. 5, 1981 [FI] Finland ..... 811751

[51] Int. Cl.[3] ..... B01D 19/00

[52] U.S. Cl. ..... 55/192; 55/194; 162/339; 162/380

[58] Field of Search ..... 55/52, 55, 189, 190, 55/194, 229, 424, 192, 193; 162/339, 380

[56] References Cited

U.S. PATENT DOCUMENTS

| | | | |
|---|---|---|---|
| Re. 27,882 | 1/1974 | Burnham | 55/55 |
| 1,774,363 | 8/1930 | Fletcher | 162/339 |
| 2,518,814 | 8/1950 | Penten | 55/55 |
| 2,571,219 | 10/1951 | Cew | 55/55 |
| 3,206,917 | 9/1965 | Kaiser | 162/380 |
| 3,407,569 | 10/1968 | Hendricks | 55/52 |
| 3,421,622 | 1/1969 | Wurtman | 55/194 |
| 3,432,036 | 3/1969 | Kaiser | 55/194 |
| 4,219,340 | 8/1980 | Kaiser | 55/55 |

FOREIGN PATENT DOCUMENTS

| | | | |
|---|---|---|---|
| 692408 | 8/1964 | Canada | 162/380 |

*Primary Examiner*—Ernest G. Therkorn
*Attorney, Agent, or Firm*—Toren, McGeady and Stanger

[57] ABSTRACT

A means for degassing paper pulp stock, comprising an elongated horizontal cylindrical tank, a distribution pipe parallel to the tank and wherefrom departs a plurality of consecutive jet tubes for introducing pulp stock into the tank close to one end of the tank, an exit tube located close to the opposite end of the tank and towards which the pulp stock flows on the bottom of the tank, members to maintain the pulp stock level constant in the tank, an additional exit tube for returning to circulation the excess pulp stock that has entered the tank, and members for producing a vacuum in the tank. The distribution pipe and the flow therewithin are directed in opposition to the flow within the tank. The cross section area of the flow diminishes towards that end of the tank where the jet tubes are located, the diminishing flow cross section area extending at least over the region of one jet tube.

5 Claims, 1 Drawing Figure

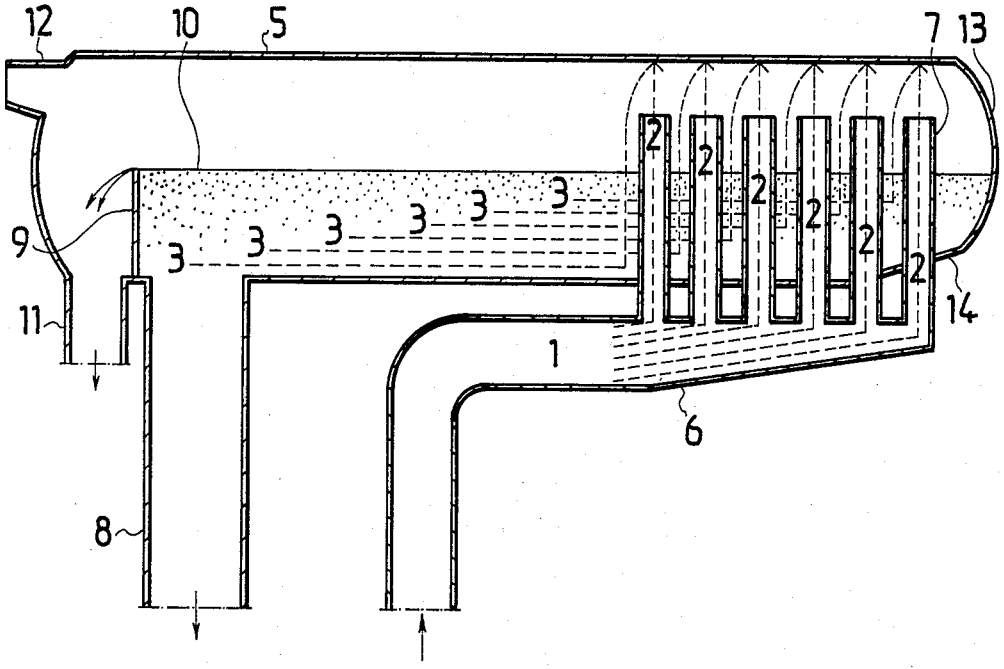
12
10
5
7
13
2
2
2
2
2
2
3
3
3
3
3
3
3
9
11
14
1
6
8

MEANS FOR DEGASSING PAPER PULP STOCK

The present invention concerns a means for degassing paper pulp stock, comprising an elongated horizontal cylindrical tank, a distribution pipe parallelling the tank and wherefrom departs a plurality of consecutive jet tubes for feeding pulp stock into said tank close to one end of the tank, and an exit tube located close to the opposite end of the tank, towards which end the pulp stock flows on the bottom of the tank, and members for maintaining the pulp stock at a constant level in the tank, and an additional exit tube for returning the excess pulp stock that has entered the tank back into circulation, and members for producing in the tank a sub-atmospheric pressure.

Means of this type are known in the art. Their main function is to minimize the quantity of gas in the pulp stock. Another significant function is to reduce the consistency variations of the pulp stock supplied into the tank. Variations of consistency are manifested on the paper machine in that they produce non-uniform paper with variable base weight. Because of this, attempts have been made to equalize the consistency before the headbox of the paper machine as perfectly as possible.

The pulp stock is supplied into the tank by a plurality of usually vertical jet tubes. From the tubes, the pulp jets up against the ceiling of the tank and therefrom it flows down to the level of the liquid surface. By effect of the vacuum in the tank, the gas in the stock boils off. From the tank, the pulp stock is conducted into the headbox of the paper machine.

The object of the present invention is to reduce the consistency variations of the pulp stock in the degassing tank and to prevent the generation of such therewithin.

In degassing tanks nowadays used, the pulp stock is fed into the jet tubes entering the tank from a distribution pipe. The distribution pipe is so mounted that the flow direction of the pulp in the pipe is consistent with the flow in the deaerating tank. This arrangement is not ideal for equalizing consistency variations in the feed tube. The lead time differences between the flows from different jet tubes into the tank and further to the exit tube are quite short and therefore the equalization of consistency in the tank is not satisfactory.

The pulp stock in the degassing tank flows longitudinally to the tank from the point of the jet tubes to the exit tube. The jet tubes are located, in the longitudinal direction of the tank, closer to one end. The tank is always constructed in the form of a cylinder; therefore its cross section area is constant. Thereby the flow in the tank towards the exit aperture at the jet tubes furthermost from this exit aperture will be minimal. Drawbacks result from such low pulp stock flow. The fibres in the pulp stock begin to settle on the bottom of the tank and local consistency variations are incurred. Moreover, as a result of the settling of fibres and of the increasing concentration, detrimental slime formation tends to occur in the tank.

With the aid of the invention the drawbacks mentioned above will be eliminated. The invention is characterized in that the distribution pipe and the flow therewithin are opposite in direction to the flow within the tank and that the flow cross section area diminishes within the tank towards that end where the jet tubes are located, the diminishng flow area extending at least over the range of one jet tube.

By this means consistency variations have been found to be allayed rather better than by any feed arrangement in current use. The difference is due to increased lead time differences between the pulps flowing to the exit tube from different jet tubes. It is thus understood that the lead time difference causes mixing of the pulp consistency variations in the tank.

In the flow within the tank no regions of slow flow can become established. Experiments have shown that the flow velocity should be higher than 0.15 m/s for no fibres to descend to the bottom of the tank and for no local variations of consistency to occur. The problem of slime also disappears.

According to an advantageous embodiment of the invention, the reduction of flow cross section area is effected by making the shell of the deaerating tank conical at the end where the jet tubes are located. In order that the jets might not hit the conical ceiling of the tank, according to an advantageous embodiment of the invention the tank is made conical only on its underside.

An advantageous embodient of the invention is characterized in that the inclination of the tank bottom at the end where the jet tubes are located is 5° to 25°, preferably 13°, in the vertical section of the tank. These values have been empirically found. The larger the diameter of the tank, the greater must be the inclination.

The invention is described in the following with reference to the drawing attached, which presents the means according to an embodiment of the invention, longitudinally sectioned.

In the drawing, the reference numeral 5 indicates an elongated, horizontal and cylindrical degassing tank. The pulp stock is introduced into the tank through a distribution pipe 6 and jet tubes 7. The distribution pipe 6 is disposed under the tank, parallel to it. The jet tubes 7, located close to one end of the tank 5, are vertical, and in the drawing six of them are depicted. The number of jet tubes 7 may naturally vary within wide limits.

Close to the opposite end of the tank 5 there is an exit tube 8, towards which the pulp stock flows on the bottom of the tank and which conducts the pulp to the paper machine. The reference numeral 9 indicates an overflow weir by the aid of which the level 10 of the pulp stock is maintained constant in the tank 5. Also other means exist for maintaining the pulp stock level 10 constant. The pulp which has passed over the overflow 9 is conducted by an additional exit tube 11 back to the circulation.

In degassing tanks of prior art the pulp stock has always been introduced into the distribution pipe 6 from the right, as viewed in the present drawing; that is, the flow in the distribution pipe 6 has had the same direction as the flow in the tank 5. As a consequence, a high-consistency portion in the pulp stock, that is an accumulation of fibres, though admittedly divided among different jet tubes to constitute partial accumulations which exit from the jet tubes at different times, is then subjected to the flow on the bottom of the tank 5 and whereby these partial accumulations may once again gather close together, forming a larger accumulation.

In contrast hereto, according to the invention, the distribution pipe 6 and the flow therewithin are directed in opposition to the flow within the tank 5. As a result, a fibre accumulation—indicated by the reference numeral 1—within the distribution pipe 6 is more efficiently dispersed. By the time the fibre accumulation 6 has moved into the jet tubes 7, it has been divided into partial accumulations 2. From the jet tube on the extreme left the partial accumulation drops as the very first into the pulp stock on the bottom of the tank 5 and thus gains a head start over all the other partial accumulations. From the jet tube 7 on the extreme right, the partial accumulation 2 discharges as the last. In this manner a lead time difference is produced between the partial accumulations which maintains them far apart, as suggested by the reference numerals 3.

As depicted in the drawing, the flow cross section area diminishes in the tank towards the end 13. This has been accomplished in that the tank is conical 13 on its underside, and this conical shape extends over the region of two jet tubes 7, while it may equally extend further. The inclination of the tank bottom is about 15° in the vertical section. With this inclination the velocity of the pulp stock will be higher than 0.15 m/s, whereby no fibres will settle on the bottom of the tank.

It is obvious to a person skilled in the art that various embodiments of the invention may vary within the scope of the claims stated below. For instance, the distribution pipe 6 need not necessarily be disposed outside the tank 5 and it may equally be located therewithin.

I claim:

1. Improvement in a means for degassing paper pulp stock, comprising an elongated horizontal cylindrical tank having a first end and a second end, a distribution pipe parallel to the tank, a plurality of consecutive jet tubes for feeding pulp stock extend from said distribution pipe into the tank closer to the first end of the tank, an exit tube located close to the second end of the tank towards which the pulp stock flows on the bottom of the tank, means for maintaining the pulp stock level constant in the tank, an additional exit tube to return the excess pulp that has entered the tank back into circulation, and means for producing sub-atmospheric pressure in the tank, wherein the improvement comprises that the flow in said tank is in the direction from the first end toward the second end and the flow in the distribution pipe is directed opposite to the flow within the tank, said jet tubes are spaced apart in the first end-second end direction, the flow cross section areas of said tank diminishes towards the first end in the tank where the jet tubes are located, the diminishing flow cross section extending at least over the region of one said jet tube, and being formed in that the tank is at least partially conically shaped.

2. Means according to claim 1, characterized in that said cylindrical tank has a horizontally extending axis with a horizontally extending underside located below and extending in the direction of said axis, and the first end of the tank where the jet tubes are located is conically shaped on its underside.

3. Means according to claim 1, characterized in that said cylindrical tank has a horizontally extending axis and the at least partly conically shaped first end is located in the btoom of said tank below the horizontal axis, and the inclination of the bottom of the tank at the first end where the jet tubes are loated is in the range of 5° to 25° relative to the horizontal axis of said tank.

4. Means according to claim 3, characterized in that the inclination of the bottom of the tank at the first end is 13° relative to the horizontal axis of said tank.

5. Means, as set forth in claim 1, wherein said jet tubes each have an upper end located within said tank with the upper end spaced upwardly from the pulp stock level in said tank, at least three said jet tubes located within said tank and at last the one of said jet tubes located closest to the first end of said tank located in the at least partly conically shaped part of said tank.

* * * * *